US007765725B2

(12) United States Patent
Jacobsen et al.

(10) Patent No.: US 7,765,725 B2
(45) Date of Patent: Aug. 3, 2010

(54) METHOD AND DEVICE FOR REMOVING SUBSEA ROCKS AND SEDIMENTS

(75) Inventors: Tom Jacobsen, Trondheim (NO); Terje Fagervold, Tustna (NO)

(73) Assignee: Fossura AS, Tustna (NO)

( * ) Notice: Subject to any disclaimer, the term of this patent is extended or adjusted under 35 U.S.C. 154(b) by 0 days.

(21) Appl. No.: 10/553,804

(22) PCT Filed: Apr. 22, 2004

(86) PCT No.: PCT/NO2004/000110

§ 371 (c)(1),
(2), (4) Date: Dec. 1, 2005

(87) PCT Pub. No.: WO2004/094735

PCT Pub. Date: Nov. 4, 2004

(65) Prior Publication Data

US 2006/0231262 A1 Oct. 19, 2006

(30) Foreign Application Priority Data

Apr. 24, 2003 (NO) ..... 20031831

(51) Int. Cl.
*B63C 7/22* (2006.01)
*E02F 3/88* (2006.01)

(52) U.S. Cl. ..... 37/317; 37/321; 37/335; 37/195; 299/9; 175/209

(58) Field of Classification Search ..... 166/357, 166/358, 352; 37/317, 318, 322, 323, 321, 37/335, 195; 175/5, 7; 299/9
See application file for complete search history.

(56) References Cited

U.S. PATENT DOCUMENTS

| | | | | |
|---|---|---|---|---|
| 4,391,468 | A * | 7/1983 | Funk | 299/8 |
| 4,674,915 | A * | 6/1987 | Shatto, Jr. | 405/191 |
| 4,718,835 | A * | 1/1988 | Maruyama | 417/171 |
| 4,750,279 | A | 6/1988 | Hofland | |
| 4,848,475 | A * | 7/1989 | Dean et al. | 166/357 |
| 6,145,223 | A | 11/2000 | Flesen | |
| 6,178,670 | B1 * | 1/2001 | Susman et al. | 37/313 |
| 6,719,496 | B1 * | 4/2004 | Von Eberstein | 405/224 |
| 6,789,291 | B2 * | 9/2004 | Velinsky et al. | 15/414 |
| 6,868,625 | B2 * | 3/2005 | Jacobsen et al. | 37/313 |
| 6,877,565 | B2 * | 4/2005 | Edvardsen | 166/352 |
| 6,966,132 | B1 * | 11/2005 | Jacobsen et al. | 37/195 |
| 2003/0121182 | A1 | 7/2003 | Jacobsen et al. | |
| 2005/0229439 | A1 * | 10/2005 | Nicholson et al. | 37/317 |

FOREIGN PATENT DOCUMENTS

| | | |
|---|---|---|
| WO | 01/32503 | 5/2001 |

* cited by examiner

*Primary Examiner*—Thomas A Beach
(74) *Attorney, Agent, or Firm*—Dennison, Schultz & MacDonald

(57) ABSTRACT

Method and device for subsea removal of cuttings from a borehole by means of ejector (5), pump (3) and suction hose (6), the ejector (5) being powered by a pump (3) that is rigidly attached to ROV (2), said ejector (5) being one with external nozzle, while said ROV (2) with pump (3) is connected to the ejector only when removal of cuttings is to take place.

9 Claims, 4 Drawing Sheets

METHOD AND DEVICE FOR REMOVING SUBSEA ROCKS AND SEDIMENTS

This application is a filing under 35 USC 371 of PCT/No2004/000110, filed Apr. 22, 2004.

BACKGROUND OF THE INVENTION

The present invention relates to a method and a device for the removal of cuttings from subsea boreholes during drilling.

On drilling boreholes in subterranean formations cuttings are formed and are transported to the surface by the drilling fluid. When drilling wells offshore e.g. for oil and/or gas production, water is commonly used as drilling fluid when drilling the uppermost parts of the holes. The cuttings will thus be contaminated and may be deposited at the sea bottom. From one single well there will typically be formed several hundred cubic meters of cuttings.

It is thus required that the cuttings are transported away from the borehole so as not to deposit large piles that obstruct further work with the well or wellhead and that may damage structures.

As drilling is a very expensive operation, high demands are made to operational reliability and sufficient capacity for the equipment to be used for transporting the cuttings. Surrounding the borehole there may be a guide base through which the drill string is arranged. By connecting a suction hose to such a guide base, the cuttings produced during drilling may be removed.

DESCRIPTION OF RELATED ART

Several technologies have been attempted to solve this problem, like the one taught by Norwegian patent No. 302 043. The disadvantage of this and other prior art technologies is that it is highly energy consuming and requires heavy equipment with separate energy supply from the surface. A consequence of the same is the need for transportation of equipment and personnel out to the drilling rig, need for storage room for equipment like winches and energy supplies, and risks related to handling of the equipment on the deck of the drilling rig and lodging of the personnel.

Furthermore there is a disadvantage of several of the prior art technologies that the cross section of the suction system has variations and therefore involves the risks for blocking and temporary stop of the drilling. It is well known that an ejector with an eccentric nozzle may be used for the suction of sediments (NO patent No. 312 541. It has, however, a strict limitation with respect to how far sediment may be transported. Still further it should be noted that an ROV may not be operated with a dredge in the immediate proximity of a drill string during drilling. Said patent does not give an answer to how to configure the equipment to always have a spare unit at hand or to have units with different properties at hand.

Several different designs of ejectors are known, e.g. from Norwegian patent application No. 2001 4843, wherein the nozzle or nozzles are arranged eccentrically so that a blocking of the ejector is avoided.

It is also common knowledge that for dredging a suction head with two inlets may be applied, allowing the suction head to be positioned on top of sediment without any risk that a suction hose becomes blocked (NO patent application No. 2001 6361).

Summary of the Invention

It is an object of the present invention to provide a method and a device for transporting cuttings from a subsea borehole during drilling, in a manner that is effective and yet requires little equipment.

The method and the device according to the invention enable the ROV or ROVs used to power the ejector, to be utilized for other applications when there is not a current need for transporting sediment. To achieve the desired versatility the ROV and the ejector are provided with each respective part of a coupling that preferably is operable by the ROV. Thus only a water pump with a particular connecting hose is mounted on the ROV, which may also be used for general purposes.

It is furthermore highly preferred that the pipe or hose system connected to the ejector has a constant diameter or at least is free from constrictions in the direction from the inlet end to the outlet end, to avoid obstacles that may lead to a blocking.

It is a benefit of the present method that it renders it possible to remove cuttings continuously while drilling the borehole, which constitutes a preferred embodiment of the method according to the invention.

To reduce the loss of energy the outlet side of the ejector is designed with a gradually increasing cross section. Such an outlet is commonly referred to as a "diffuser".

Another advantage of the method and the device according to the invention is that it comprises a lightweight, ROV based suction equipment (corresponding to Norwegian patent No. 312 541) to remove sediment from sites with limited (constricted) access. Thereby the water pump supplying water to the ejector may be powered by the standard power supply for the ROV. The suction unit as such is designed in a way that it not only gets access to constricted sites, but also in a way as to not damage vulnerable components and equipment.

DESCRIPTION OF THE PREFERED EMBODIMENTS

Figure 1:
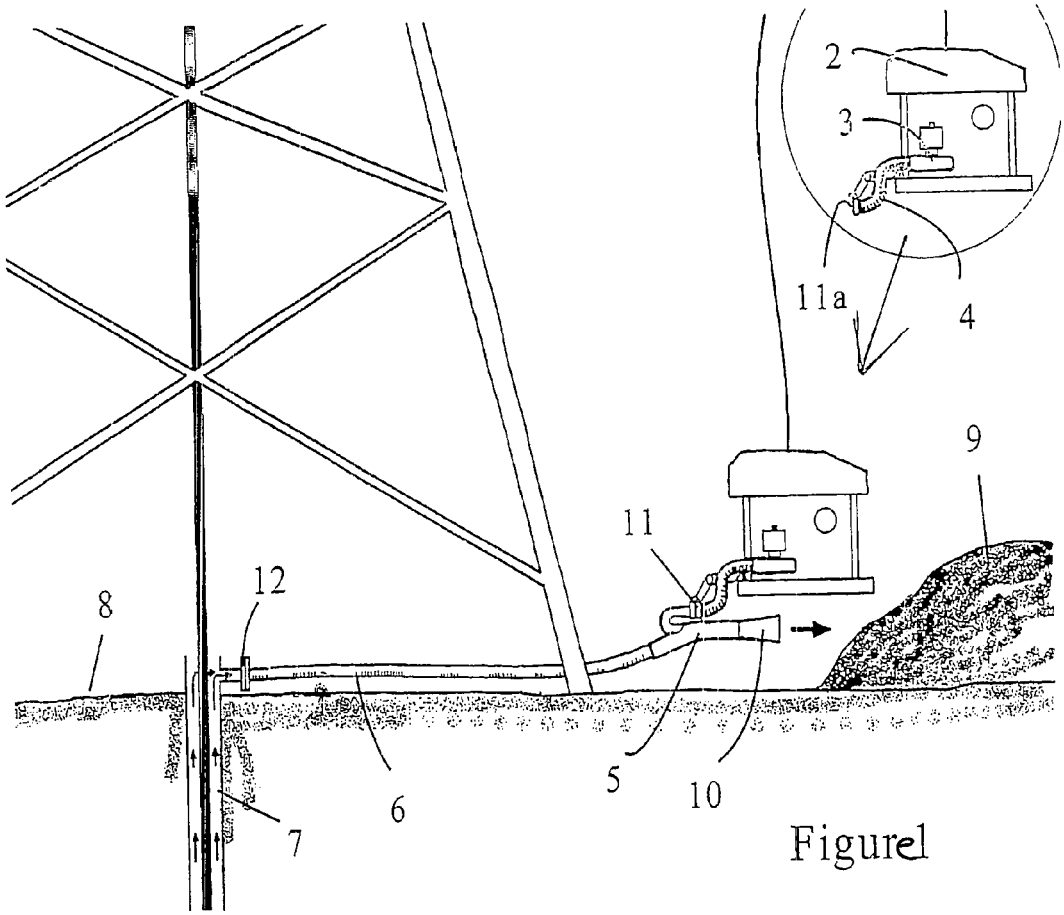
FIG. 1 is a schematic view of an embodiment of a device according to the invention.

FIG. 1 shows schematically how an assembly (unit) 1 (encircled) comprising an ROV 2 with thereto attached water pump 3, connecting hose 4 and a first part 11*a* of a coupling, may be moved adjacent to, and easily be connected to another unit comprising the ejector 5 with suction hose 6 or pipe that in the Figure is shown connected to a borehole 7 close to the sea bottom 8, in order to pump cuttings from the borehole to a land fill 9 at a distance form the borehole 7. The ejector 5 is furnished with another part 11*b* of the coupling 11, adapted to be connected to the first part 11*a* of said coupling.

The suction hose or pipe 6 has a mainly constant cross section along its entire length and is arranged as straight as possible. The ejector 5 comprises a tubing of mainly constant diameter corresponding to the diameter of the suction hose 6. In the shown embodiment the ejector is furnished with a widened outlet end piece 10 functioning as a diffuser and contributes to provide a best possible suction force from the available power. The ejector comprises one or several power nozzles (not shown) that are supplied with water by the water pump 3. It is preferred that the ejector 5 according to the invention is of a type with externally arranged nozzles as described in Norwegian patent No. 312 541. It is still further preferred that the ejector 5 has a straight ejector tubing with two or more nozzles arranged symmetrically around the tubing as described in Norwegian patent application No. 2001 4843.

The assembly 1 of ROV 2/ pump 3/connecting hose 4 may easily be connected to and disconnected from the ejector 5 as desired, by the coupling 11. This way the ROV may also be used for other purposes. Furthermore the suction hose 6 may be adapted for connection to the borehole 7 with another coupling 12. It is preferable that the couplings 11 and 12 are of such a type that they may be operated by an ROV, preferably the ROV to which they are to be connected. Typically the coupling 11 will be of a type commonly referred to as a rapid coupling. The construction of the coupling 11 as such is not important, though it will generally comprise a locking member that on a short rotating movement or a simple axial movement provides for a sealed locking of the coupling parts ll*a* and ll*b* to each other. The locking member will typically be operable by the common, external manipulators arranged on an ROV. The second coupling 12 may be of the same type as coupling 11 or of another type.

The ejector 5 is supplied with water by the water pump 3. A central feature of the method according to the invention is that the current ROV 2 may be connected to an ejector 5 with a suction hose 6 only when the need for removing sediment arises. Thereby the same ROV 2 is available for other operations when there is no need of removing sediment. Incidentally, it is convenient if the water pump 3 for supplying water to the ejector is also arranged to supply water to at least one nozzle arranged at or near the inlet end of the suction hose 6 for back-flushing sediment that possibly get stuck in the inlet opening. This at least one nozzle (not shown) should also be arranged externally of the hose or pipe 6 so as to not limit its cross section.

Figure 2:
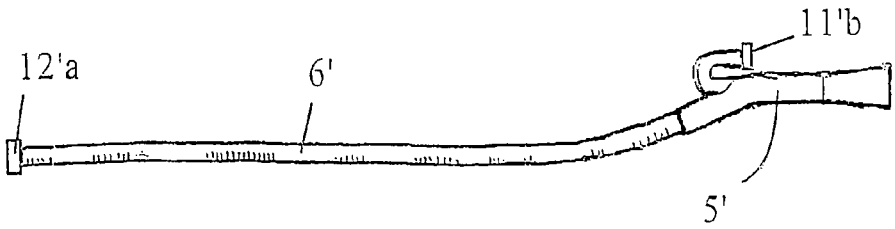
FIG. 2 is a view of a "spare" ejector with a suction hose according to the invention.

Normally the ejector 5 will make use of the power available on the current ROV 2, e.g. in the form of hydraulic power. Several work grade ROVs have available a hydraulic power corresponding to 20-30 kW. Compared to the need this is a comparatively limited effect. The ejector 5 and suction hose 6 must therefore be designed for optimum utilization of the effect in order to achieve a suction force that is sufficient to remove the amounts of cuttings that are produced. Furthermore it is important that the velocity in the suction hose 6 is sufficiently high to avoid that sediment settles and clogs the suction hose 6 or an optional discharge hose 14. FIG. 2 shows a "spare" ejector 5' with suction hose 6' provided with respective parts 11*b'* and 12*a'* of couplings 11 and 12. This spare unit may be identical to the unit shown in FIG. 1 but it may also be different from this with respect to diameter and/or length.

It is a preferred feature of the method according to the invention to keep in a state of readiness such a spare unit comprising ejector 5' and suction hose 6', which may easily be connected if the primary unit gets clogged or for other reasons needs to be replaced.

The spare unit may in its state of readiness be located at the sea floor alongside a borehole. It will furthermore be possible to mount the spare unit/ units to the guide base through which the drill string is arranged, so that replacement to the spare suction hose/ejector unit may be done very rapidly.

Spare units may have properties that are different from the properties of the primary ejector 5 and suction hose 6. For example the length of the suction hose 6' may be different from the length of the suction hose 6. If the length of the hose gets shorter, the suction capacity will get higher but the sediment will be moved a shorter distance. It is fully possible to hold available several different spare units.

Figure 3:
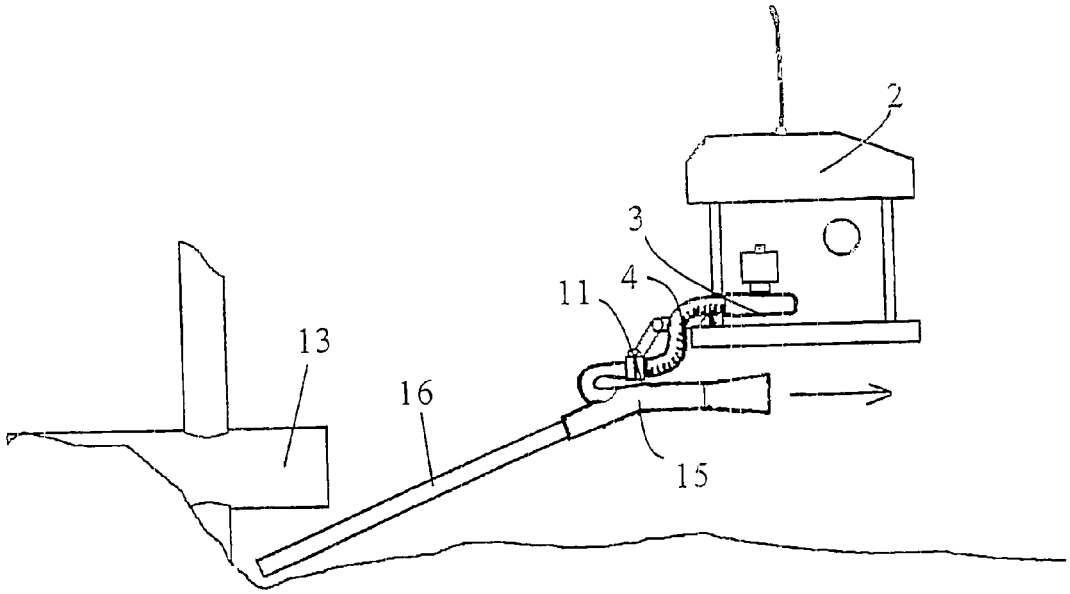
FIG. 3 is a schematic view of an alternative device according to the invention.

FIG. 3 illustrates how an ROV 2 with pump 3 and connecting hose 4 with coupling 11 as shown in FIG. 1, may be used with another type of equipment. The other type of equipment shown in FIG. 3, is an ejector 15 with a mainly rigid and comparatively short mouth piece 16, for moving sediment away from an area which is typically difficult to access, such as from beneath a fixed construction 13 in the form of a quay, pier or the like.

For many purposes it will be convenient that the suction hose 6 is flexible, since such a hose is simpler to handle than a rigid pipe, and since it allows positioning its outlet end more freely. The inlet end of the suction hose is positioned near the site where the cuttings are discharged from the borehole. If the drill string is positioned within a guide base, there will normally be means for attachment of the suction hose to the same. It should be emphasized that the scope of the invention also includes a rigid pipe, a rigid, hinged pipe or a combination of a rigid pipe and a flexible hose.

Figure 4:
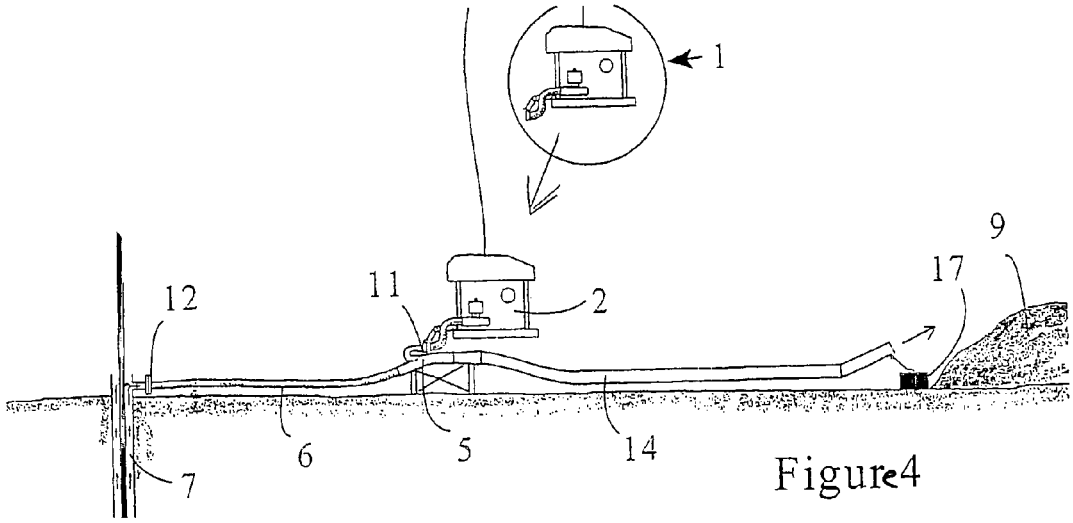
FIG. 4 is a view of the embodiment according to FIG. 1, also including a hose on the pressure side of the ejector.

FIG. 4 shows an alternative embodiment of the invention, by which a discharge hose 14 is arranged at the outlet side or the pressure side of the ejector, for thereby further increasing the distance that the cuttings may be transported away from the borehole. At the end of the discharge hose 14 is shown a device 17 for moving the outermost end of the discharge hose as the landfill 9 of cuttings grows. Like for the suction hose 6 also the discharge hose 14 may have the form of a mainly rigid pipe while it is preferred that at least parts of the discharge hose is flexible.

Figure 5:
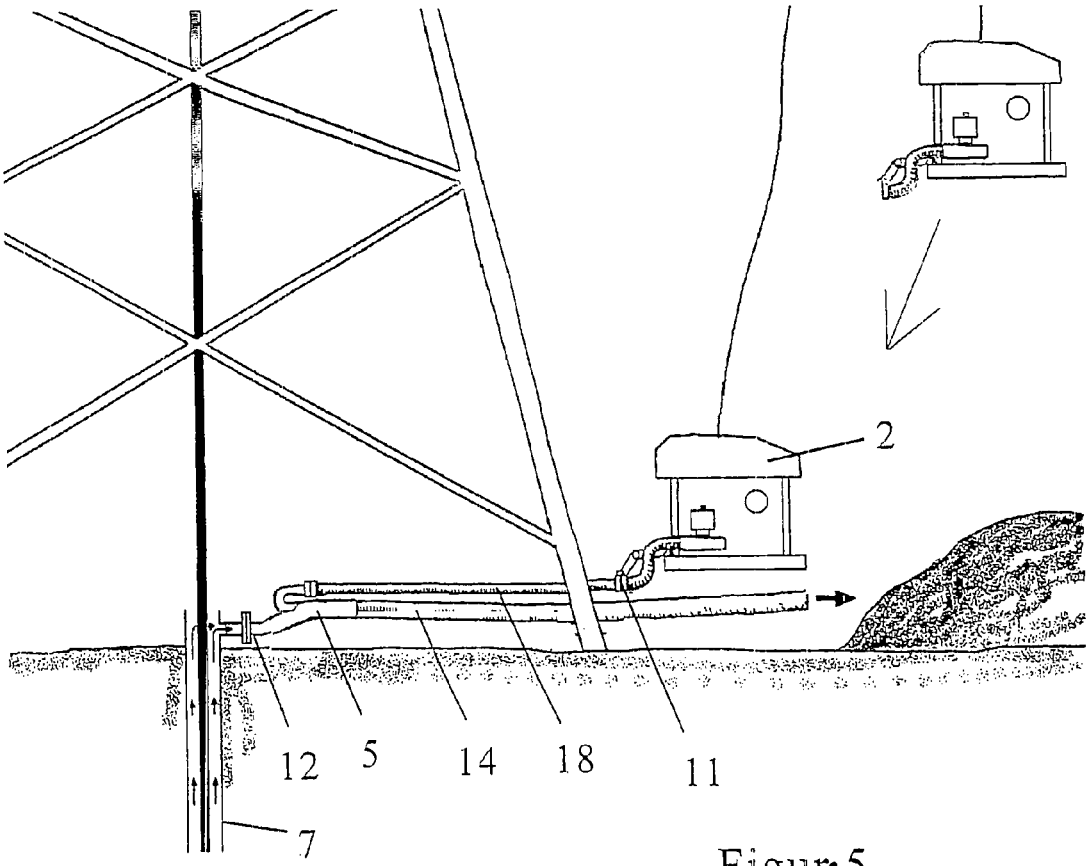
FIG. 5 shows an alternative to the embodiments shown in FIG. 1 and FIG. 4.

FIG. 5 shows yet another embodiment of the invention. The particular feature of this embodiment is that the ejector unit 5 by means of a coupling 12 is connected directly to a casing or the like of a well without any intermediate suction hose. Like with the embodiment of FIG. 4, a discharge hose 14 for the transportation of the cuttings from the ejector 5 to a landfill 9 is connected to the ejector. Since it may be difficult to access the regions close to a well with an ROV or the like, an extension hose 18 for water is arranged from coupling 11 on ROV 2 to the ejector 5.

Figure 6:
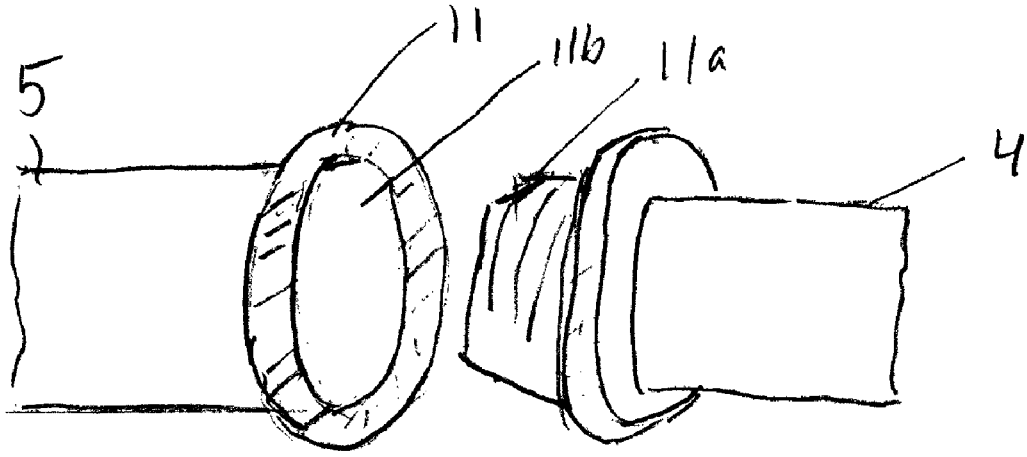
FIG. 6 is an enlarged perspective view of a coupling between an connector hose and an ejector according to the invention.

FIG. 6 shows an enlargement of the coupling between the connecting hose 4 and the ejector 5. The coupling is a quick connect coupling as is well known in the art, including a male portion ll*a* and a female portion 11*b*, easily connected and disconnected by an ROV by simple axial or radial movement.

It is often a need for renovation/clearing around a borehole after the drilling has been completed, or a need for removal of sediment that are difficult to access. For such purposes an ejector based dredge that also may be positioned on the sea floor, may be used. This dredge (or if there is a need for more than one these dredges) may be provided with a long pointed suction head that advantageously may be made in a soft material, like plastic. Thus, sediment may be removed from sites that are difficult to access without damaging vulnerable components. The suction head may also have the form of a double pipe, so that it does not risk clogging of the pipe even when working in compact sediment (cf. the suction head of Norwegian patent application No. 2001 6361). There is nothing preventing the use of several different dredges should the need for that arise.

If sediment is to be removed e.g. from a pile of cuttings, it might be desirable to position the suction head on top of the pile. In such cases it is preferred that the inlet end of the suction hose 6, 6' to arrange a suction head with two inlet openings arranged at a vertical distance from one another, so that the uppermost inlet is arranged to suck in only water while the lowermost inlet opening is arranged to suck in sediment and water. Such a suction head may be left alone without control or surveillance without any risk of getting clogged.

The invention claimed is:

1. Device for removal of cuttings from a borehole with the use of an ejector, comprising:

a first unit in the form of an ROV including a rigidly attached ejector pump and a connecting hose attached to the ejector pump, the connecting hose terminating at an opposite end in a first coupling part; and a second unit movable with respect to the ROV, and comprising an ejector having a suction portion attached to a suction hose, a discharge portion, and a nozzle having an outlet disposed between the suction portion and the discharge portion and an inlet connected to a conduit having at an end opposite to the nozzle an inlet provided with a second coupling part, said first coupling part and said second coupling part comprising a selective rapid coupling means including a locking member operable for locking together and unlocking the first and second coupling parts by at least one of a rotational and axial movement, said first unit comprising an ROV linkage connectable to said locking member, and constructed and arranged for operating said locking member, to enable thereby rapid coupling of the ejector to the connecting hose, and rapid uncoupling of the ejector from the connecting hose.

2. Device as claimed in claim 1, wherein the suction hose has an inlet end opposite to the ejector comprising a first coupling part of a second coupling, arranged to be selectively connected to a second coupling part of the second coupling of a guide base at a borehole.

3. Device as claimed in claim 1, wherein the ejector pump supplies the ejector with water, and is powered by a power supply for the ROV.

4. Device as claimed in claim 1, wherein the ejector is arranged at an outlet end of the suction hose.

5. Device as claimed in claim 1, wherein a discharge hose or pipe is connected to an outlet side of the ejector for transportation of sediment further away from a borehole.

6. Device as claimed in claim 1, wherein the suction hose and the ejector have a common, substantially constant cross section.

7. Device as claimed in claim 1, wherein the ejector has an outlet end of gradually increasing cross section.

8. Device for removal of cuttings from a borehole with the use of an ejector, comprising:

a first unit in the form of an ROV including a rigidly attached ejector pump and a connecting hose attached to the ejector pump, the connecting hose terminating at an opposite end in a first coupling part; and a second unit movable with respect to the ROV, and comprising an ejector having a suction portion attached to a suction hose, a discharge portion, and a nozzle having an outlet disposed between the suction portion and the discharge portion and an inlet connected to a conduit having at an end opposite to the nozzle an inlet provided with a second coupling part, said first coupling part and said second coupling part including a locking member operable by the ROV for locking and unlocking the first and second coupling parts by at least one of a rotational and axial movement, said first unit comprising an ROV linkage connectable to said locking member, and constructed and arranged for operating said locking member, to enable thereby rapid coupling of the ejector to the connecting hose, and rapid uncoupling of the ejector from the connecting hose, said ejector being attached at a suction portion to a first coupling part of an additional coupling, the first coupling part of the additional coupling being constructed and arranged for selective attachment to a second coupling part of the additional coupling, the second coupling part of the additional coupling being connected to a guide base around a borehole, the ejector having an outlet side connected to a discharge hose.

9. Device as claimed in claim 8, additionally comprising a selectively coupled extension hose disposed between the ejector and the ejector pump.

* * * * *